United States Patent [19]

Grundler et al.

[11] 4,060,103

[45] Nov. 29, 1977

[54] BRAKESHOE FOR SHUTTLE BRAKES OF LOOMS

[75] Inventors: Robert Gründler, Arbon; Hubert Jenny, Gotzis, both of Switzerland

[73] Assignee: Aktiengesellschaft Adolph Saurer, Arbon, Switzerland

[21] Appl. No.: 773,524

[22] Filed: Mar. 2, 1977

[30] Foreign Application Priority Data

Mar. 29, 1976 Switzerland ..... 3904/76

[51] Int. Cl.[2] ..... D03D 49/54

[52] U.S. Cl. ..... 139/185

[58] Field of Search ..... 139/183, 185, 186, 187

[56] References Cited

U.S. PATENT DOCUMENTS

| | | | |
|---|---|---|---|
| 820,663 | 5/1906 | Mills | 139/186 |
| 2,399,851 | 5/1946 | Brown | 139/185 |
| 3,096,794 | 7/1963 | Kronoff | 139/185 |
| 3,429,345 | 2/1969 | O'Donnell | 139/186 |
| 3,865,150 | 2/1975 | Demuth | 139/185 |

*Primary Examiner*—Henry S. Jaudon

*Attorney, Agent, or Firm*—Bailey, Dority & Flint

[57] ABSTRACT

A brakeshoe for shuttle brakes on a loom which stops a shuttle in a shuttlebox after the shuttle has inserted a filling yarn during weaving cloth. The brakeshoe includes an arcuate shaped rigid support member. Positioned on top of the acrcuate shaped rigid support member is a rubber layer which has a height decreasing with increasing distance from the selvage of the cloth. A coating of abrasion proof material such as shett steel, covers the upper surface of the rubber layer on a side next to the shuttlebox for engaging the shuttle as it enters the shuttlebox.

7 Claims, 3 Drawing Figures

BRAKESHOE FOR SHUTTLE BRAKES OF LOOMS

BACKGROUND OF THE INVENTION

The present invention relates to a brakeshoe for a shuttle brake on a loom, and more particularly to a brakeshoe which has a lining thereon that exerts a braking effect on the shuttle.

In conventional brakeshoes a rigid plate, some with and some without linings, is supported resiliently with respect to a rigid wall of a shuttlebox that lies in prolongation of the reed. A spring force or other forces acting on the resilient plate forces the shuttle towards the rigid wall thereby generating a braking force. The force varies with the applied force which grows from zero at the instant of first contact between the shuttle and the brakeshoe up to a maximum value which corresponds with complete retreat of the shoe in the presence of the shuttle in the shuttlebox. There is a problem of maintaining a constant force on the shuttle over long periods of time because of wear and fatigue of the springs. Furthermore, the braking force varies with the coefficient of friction between the surface of the shuttle and the counterfaces of the rigid and yielding walls. This coefficient of friction often experiences considerable alterations in service because it is determined by different influences such as the state of the surfaces, himidity of the air or temperature.

Since the speed of the entry of the shuttle into the shuttlebox can likewise fluctuate the impact against the stop which defines the end position of the shuttle takes place with a varying degree of violence. Often the shuttle bounces off the stop so that the end position of the shuttle is not constantly the same. This has adverse affects on the succeeding throwing of the shuttle, and may also lead to difficulties in changing the spool.

As a remedy it has already been proposed (Swiss Pat. No. 512,609) to have a flywheel mass accelerated first of all by the shuttle and to make use of the energy imparted to the flywheel mass by the shuttle for forcing the shuttle up against a stop, so that the shuttle always reaches the same brake position against the stop. As a result, a correct and consistent position of rest of the shuttle takes place. One problem with such a device is it requires costly mechanism with moving components.

SUMMARY OF THE INVENTION

In one particular embodiment the brakeshoe constructed in accordance with the invention includes a lining which is applied to a rigid carrier and comprises a rubber layer of constant width and having a height which decreases with increasing distance from the selvage of the cloth. A coating of abrasive proof material such as sheet steel, or the like covers the rubber layer on the side next to the shuttlebox. The coating may be formed of individual segments set inversely to the direction of the filling yarn. As a result of this configuration, bending stresses generated during operation of the abrasion proof material are reduced and at the same time the local resilience is increased. The dimensions of the segments in the direction of the filling yarn are in reverse ratio to the height of the supporting layer of rubber, i.e., to the resilience of this rubber layer.

In order to avoid damage to the shuttle during the braking operation and to facilitate the entry into the shuttlebox the edges of the segments on the side next to the shuttlebox are rounded and the ends next to the selvage of the cloth is formed to a taper-like wedge towards the selvage.

Accordingly, it is an object of the present invention to provide a relatively simple brakeshoe which requires a minimum amount of maintenance for braking the shuttle as it enters the shuttlebox in such a way that the stopping position of the shuttle is constantly the same.

Another important of the invention is to provide a brakeshoe for use with a shuttlebox for stopping the motion of a shuttle which has a lining thereon that has a decreasing resilience as the distance from the selvage increases.

Still another important object of the present invention is to provide a brakeshoe for use in a shuttlebox wherein the resiliency of the shoe decreases in a progressive manner from the beginning point.

These and other objects and advantages of the invention will become apparent upon reference to the following specification, attendant claims and drawing.

DESCRIPTION OF A PREFERRED EMBODIMENT

Figure 1:
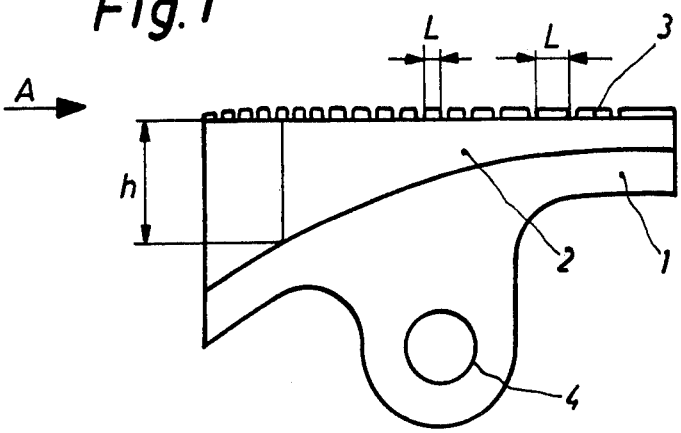
FIG. 1 is a side elevational view of a brakeshoe constructed in accordance with the present invention.
Figure 2:
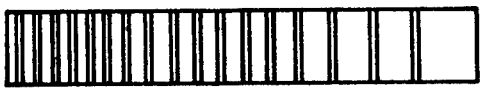
FIG. 2 is a plan view of a brakeshoe illustrated in FIG. 1.

Onto a carrier 1 which is an arcuate surface such as illustrated in FIG. 1, a rubber layer 2 is fastened by any suitable means such as vulcanizing. This rubber layer has in the direction away from the selvage or in the direction of the arrow A in which the shuttle (not shown) arrives, a decreasing height H. The rubber layer 2 acts as the backing for segments 3 constructed of sheetmetal or other suitable rigid and hard material.

Figure 3:
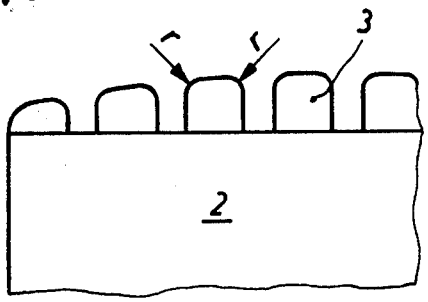
FIG. 3 is an enlarged side elevational view illustrating on a larger scale the end of the brakeshoe that would be positioned next to the selvage of the cloth.

The edges of the segments are rounded off on the outside to a radius R as illustrated in FIG. 3. The width L of the segment 3 increases with decreasing height H of the backing. The carrier or rigid support 1 has a bearing bore 4 for pivotal support of the carrier in a shuttlebox.

The favorable action of the brakeshoe shown can be accounted for by the fact that the lateral compressive force exerted by it on the shuttle and hence the force of friction grows steadily the further the shuttle penetrates into the shuttlebox. The energy dissipated by the work due to friction, which corresponds with the kinetic energy of the entering shuttle, increases progressively and not linearly as in the case of a force of friction from the conventional shuttle brake, which remains at about a maximum value. Through this progression the stopped position of the shuttle is kept essentially the same.

While a preferred embodiment of the invention has been described using specific terms, such description is for illustrative purposes only, and it is to be understood that changes and variations may be made without departing from the spirit or scope of the following claims.

What is claimed is:

1. A brakeshoe for shuttle brakes of looms upon which cloth is woven comprising:

a. a rigid arcuate shaped support member; and b. a resilient lining carried on said arcuate shaped support member having a resilience which decreases progressively with the distance from a front end of said lining facing the selvage of said cloth being woven on said loom towards the remote end.

2. A brakeshoe for shuttle brakes on a loom which stops a shuttle in a shuttle box after the shuttle has inserted a filling yarn during weaving cloth, said brakeshoe comprising:

a. a rigid support member, b. a rubber layer carried on said rigid support member having a height decreasing with increasing distance from the selvage of said cloth; and c. a coating of abrasion proof material covering said rubber layer on a side next to the shuttlebox for engaging the shuttle as it enters said shuttlebox.

3. The brakeshoe as set forth in claim 2 wherein said coating comprises:

a plurality of individual segments directed transversely to the direction of the filling yarn.

4. A brakeshoe as set forth in claim 3 wherein the width of the segments in the direction of the filling yarn varies in an inverse ratio to the height of said rubber layer.

5. A brakeshoe as set forth in claim 4 wherein the edges of said segments on the side which normally face the shuttlebox are rounded off.

6. The brakeshoe as set forth in claim 2 wherein the surface of said coating which is supported on said rubber layer is tapered like a wedge in the direction towards the selvage of said cloth.

7. A brakeshoe for a shuttle brake on a loom which stops a shuttle in a shuttlebox after the shuttle has inserted a filling yarn during weaving cloth, said brakeshoe comprising:

a. a rigid arcuate shaped support member;

b. a rubber layer carried on said rigid support member having a height decreasing with increasing distance from the selvage of said cloth; and c. a coating of abrasion proof material covering said rubber layer on a side next to the shuttlebox for engaging the shuttle as it enters said shuttlebox.

* * * * *